United States Patent [19]

Graser

[11] 4,003,514

[45] Jan. 18, 1977

[54] FROZEN FOOD TRAY

[75] Inventor: Earl J. Graser, Monroe, La.

[73] Assignee: Olinkraft, Inc., West Monroe, La.

[22] Filed: Jan. 21, 1976

[21] Appl. No.: 651,093

[52] U.S. Cl. ..... 229/34 HW; 229/51 TC

[51] Int. Cl.[2] ..... B65D 5/22

[58] Field of Search ..... 229/34 HW, 31 FS, 30, 229/51 TC

[56] References Cited

UNITED STATES PATENTS

| | | | |
|---|---|---|---|
| 2,447,243 | 8/1948 | Freel et al. | 229/34 HW |
| 2,495,807 | 1/1950 | Buttery | 229/34 HW |
| 3,301,391 | 1/1967 | Guyer | 229/51 TC X |
| 3,572,576 | 3/1971 | Foster | 229/31 FS |
| 3,606,078 | 9/1971 | Phillips, Jr. | 229/31 FS |
| 3,810,574 | 5/1974 | Gardner | 229/31 FS |
| 3,863,832 | 2/1975 | Gordon et al. | 229/30 |
| 3,917,155 | 11/1975 | Bemiss | 229/30 X |

*Primary Examiner*—Davis T. Moorhead
*Attorney, Agent, or Firm*—O'Brien & Marks

[57] ABSTRACT

A new and novel tray for storing and reheating frozen food. The base portion of the tray is formed in a one-piece construction having spaced apart hollow side walls and double thickness end walls both side and end walls being adhesively secured to the underside of the tray. Corner web-like folds positioned between inner panels of the side and end walls are held in place by securing flaps on the outer panels and are secured to the tray. The folding of the side walls and end walls in combination with the corner web-like folds makes the interior portion of the tray leakproof. A separate one-piece lid may be adhesively secured to the top of the hollow side walls and to the sides of the end walls to enclose the tray and make a completely leakproof package. In the preferred embodiment the tray and lid of the package are formed generally of paperboard and may be coated with desirable coatings. The package may also be formed with foil laminations on one or both sides thereof.

1 Claim, 12 Drawing Figures

FROZEN FOOD TRAY

BACKGROUND OF THE INVENTION

This invention relates generally to frozen food trays and more particularly to a new and novel frozen food package having a lid attached. The frozen food package may be used in either conventional or microwave ovens. This versatility of use in either type oven enables the packager of frozen food to eliminate the need for two types of frozen food packages. Use of the new and novel frozen food package would appeal to the housewife who uses the conventional type oven as well as the housewife who uses the more recent microwave oven.

Many of the prior art frozen food packages are formed from aluminum which cannot be used in today's modern microwave ovens. These aluminum packages are not only restricted to use in conventional ovens but are also more costly to manufacture and do not have the structural stability built into the applicant's frozen food tray.

Many prior art aluminum type frozen food packages required an inner container in which the frozen food was placed and also an outer paperboard container which not only protected the aluminum container from damage during shipping and storage but which also provided a means for imprinting the advertising of the packager. Oftentimes the outer paperboard container was not printed itself but had an additional paper layer on which the advertising was printed. Not only did this add to the expense of the package, but it was necessary that the housewife remove the outer paperboard container and additional paper layer before reheating the frozen food contained within the aluminum inner container.

The applicant's new and novel frozen food tray, having a separate one-piece lid, is constructed so that it not only provides the structural stability required to protect the contents of the package, but it may also have printed on its exterior portion the packager's advertising thus eliminating the need for an outer package and resulting in a greater cost savings for the packager and the ultimate consumer.

Another problem encountered in today's mechanized world is the speed of packaging. The folding and gluing of the applicant's new and novel frozen food tray is well suited to today's high speed packaging lines. The elimination of an outer package also increases the speed of packaging and results in even further savings to the packager of frozen food and the ultimate consumer.

Still yet another problem facing the food packaging industry is that of securing a leakproof tray. Many prior art trays were constructed in such a manner that they were leakproof to the extent that contents contained within the tray could not leak to the outside of the tray, but seepage could occur between the interior and exterior walls of the tray. The problem is particularly prevalent in the packaging of foods containing sauces, gravies and the like. Examples of prior art trays of this type are shown in U.S. Pat. No. 2,531,255 issued to J. D. Clarke on Nov. 21, 1950, and U.S. Pat. No. 2,628,012 issued to M. Goldsholl on Feb. 10, 1953.

The container shown in U.S. Pat. No. 2,531,255 teaches a one-piece construction having spaced apart side and end walls which fold inwardly toward the base portion to form the erected carton. Openings 29 in panel 14 receive extending members 30 of panel 23 to hold the spaced apart end walls in locked position when the carton is set up for use.

U.S. Pat. No. 2,628,012 teaches a paperboard carton having hollow side and end walls which are formed by folding the panels and flaps inwardly. Extensions on the inner side wall panels 12 are folded inwardly to strengthen the end construction of the carton. Tabs on the end panel lock into position in the inner side wall panel. This carton is designed primarily to protect the contents of the carton from dust or breakage and can be used for display purposes.

The new novel frozen food tray disclosed by the applicant is formed from a construction having spaced apart hollow side walls and double thickness end walls which are adhesively secured to the underside of the base portion of the package. The folding sequence of the side and end walls in conjunction with the folding of the corner web-like folds provide a continuous interior from which no leakage, either to the outside of the package or between the side and end walls, will occur. This is especially important in the packaging of frozen foods containing varying degrees of liquids.

U.S. Pat. No. 3,082,928 issued to R. H. Schenk on Mar. 26, 1963 teaches a tray having spaced apart end walls and double thickness side walls. The spaced apart end walls are filled with a thermoplastic material, and the side walls extend to close the opening of the spaced apart end walls. The tray is sealed with a membrane and inserted in a sleeve to maintain sterility of the products contained within. While this package would provide for sterility of the products contained within the tray, it would not incorporate the leakproof feature taught by the applicant's invention. Seepage of the contents of the package could occur at the corners of this prior art tray.

Other prior art packages are cited herein to show the state of the art and are shown in the U.S. Pat. No. 3,298,505, issued to E. E. Stephenson, on Jan. 17, 1967; the U.S. Pat. No. 3,606,078, issued to F. L. Phillips, Jr., on Sept. 20, 1971; the U.S. Pat. No. 3,572,576, issued to Thomas W. Foster, on Mar. 30, 1971; the U.S. Pat. No. 3,876,132, issued to Morris W. Kuckenbecker on Apr. 8, 1975; the U.S. Pat. No. 2,071,949, issued to S. Reich, on Feb. 23, 1937; and the U.S. Pat. No. 3,863,832, issued to Robert L. Gordon et al on Feb. 4, 1975.

SUMMARY OF THE INVENTION

In order to overcome the problems inherent in the prior art trays and to provide a frozen food tray which may be used in either the conventional oven or the microwave oven, there is provided by the applicant's new and novel frozen food tray a construction having a plurality of opposed spaced apart hollow side walls and a plurality of opposed double thickness end walls. Corner web-like folds positioned between the inner panels of the side and end walls close the walls in such a manner so as to provide a continuous leakproof interior. A separate one-piece lid having a reverse cut tear-out portion is adhesively secured to enclose the top portion of the tray thus making the package completely leakproof.

Accordingly, it is an object of the invention to provide a new and novel frozen food package for use in either conventional or microwave ovens.

Another object of the invention is to provide a new novel frozen food tray which is leakproof not only to the outside of the tray but to the extend that liquids cannot seep between the interior and exterior walls of the tray.

Another object of the invention is to provide a frozen food package which may have advertising imprinted on its exterior portion and eliminating the need for a costly additional outer package.

Yet another object of the invention is to provide a new and novel frozen food tray or package possessing the necessary structural stability to withstand shipping and storing damage without the need for an additional outer package.

Still yet another object of the invention is to provide a new and novel frozen food tray which may be formed inexpensively and may be easily assembled by the frozen food packer.

These and other objects and advantages of the invention will become apparent from a review of the specification and from a study of the drawings detailing the preferred embodiment.

DESCRIPTION OF THE PREFERRED EMBODIMENT

Figure 1:
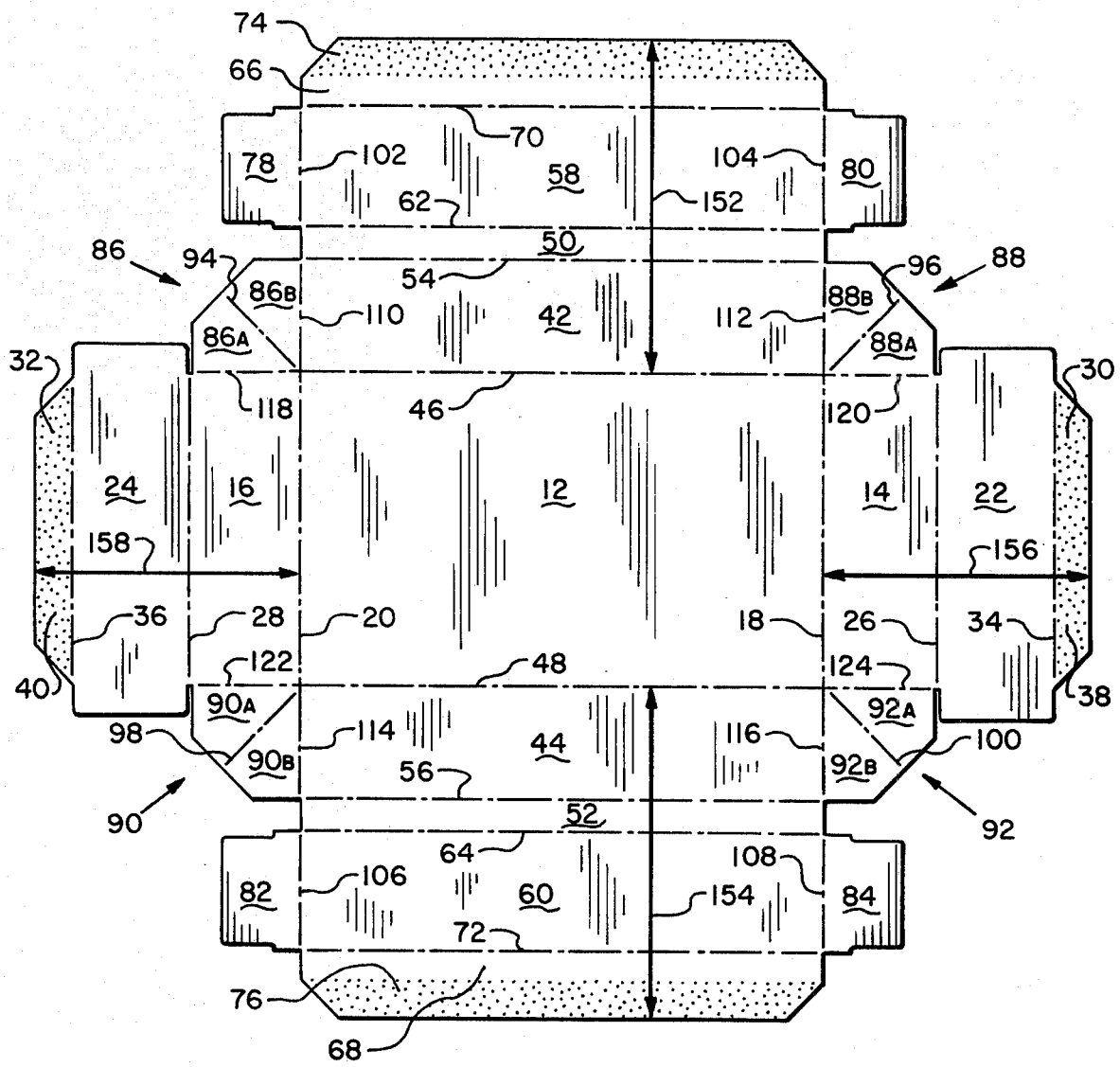
FIG. 1 is a bottom plan view of the production blank of the subject frozen food tray shown prior to its being folded and after having had a predetermined amount of adhesive applied to both the narrow flaps and elongated flaps.
Figure 3:
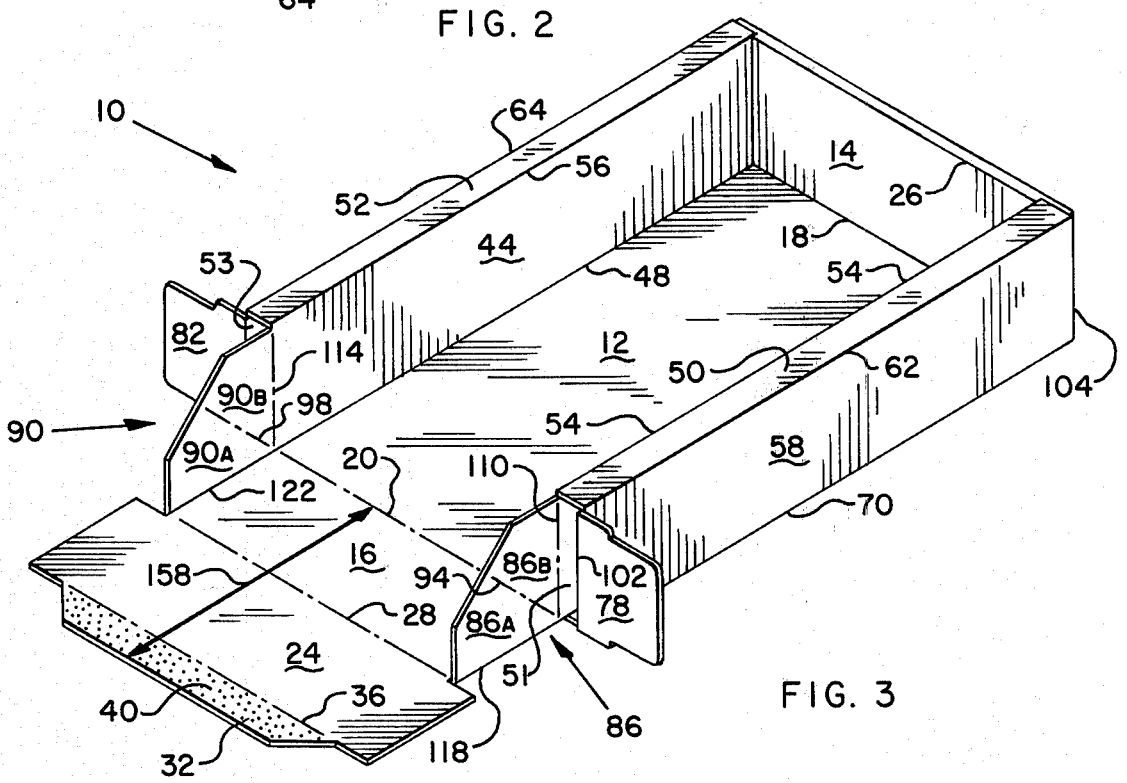
FIG. 3 is an isometric view of the partially formed frozen food tray showing both upstanding spaced apart hollow side walls and one upstanding double thickness end wall in position and the other end wall and securing flaps about to be folded into position.
Figure 4:
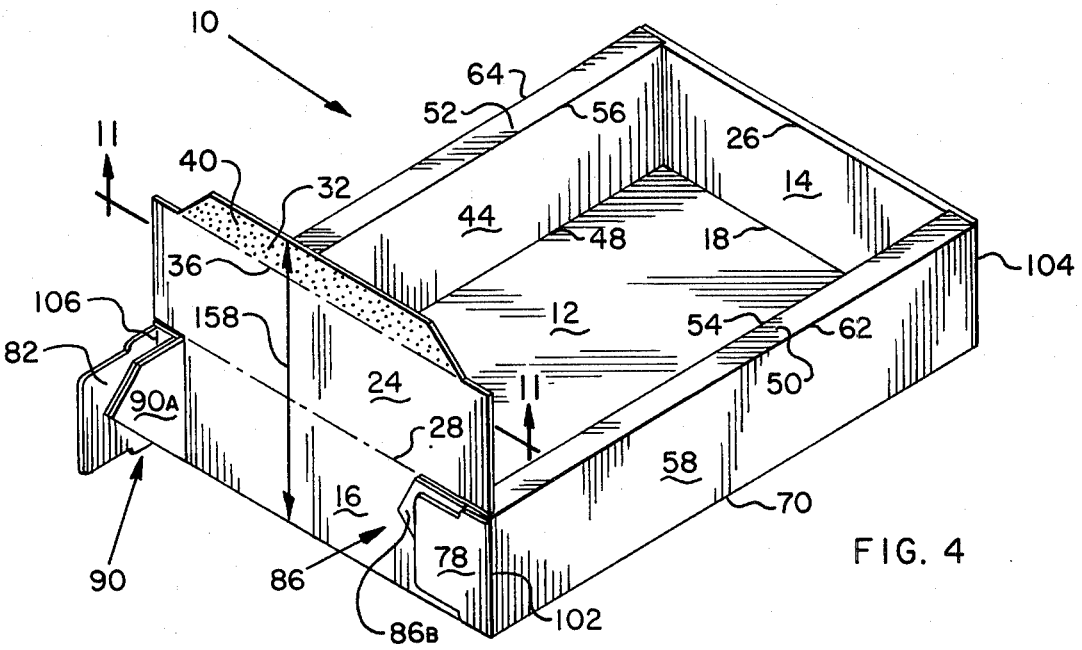
FIG. 4 is an isometric view of the frozen food tray shown in FIG. 3 showing the next step in the folding sequence in which one of the corner web-like folds has been folded, positioned, and secured between the inner panel of the double thickness end wall and one of the securing flaps and the other corner web-like fold is about to be positioned in a like manner just prior to being enclosed by the outer panel of the end walls.
Figure 5:
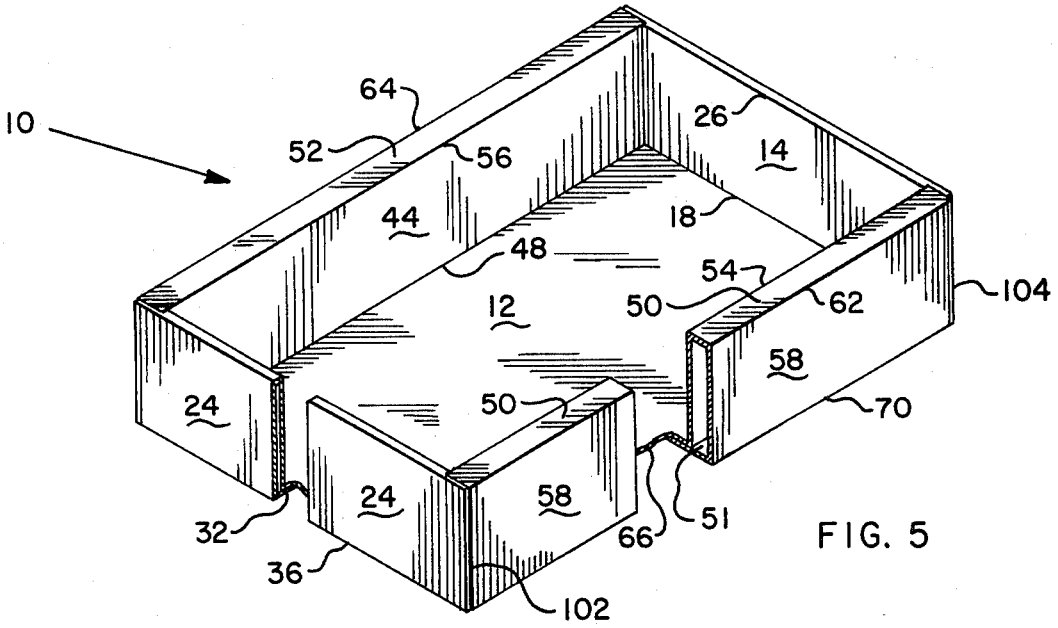
FIG. 5 is an isometric view shown partially in section of the completely erected frozen food tray.

Referring now to the drawings in general and more particular to FIG. 1 of the drawing, there is shown a bottom plan view of the production blank of the subject frozen food tray 10 shown in FIGS. 3–5. The production blank comprises a centrally-located base portion 12 having hingedly connected on one end thereof by means of the scoreline 18 an inner panel 14 and having hingedly connected on the opposite end thereof by means of the scoreline 20 an inner panel 16. The inner panel 14 has hingedly connected thereto on the side opposite scoreline 18 an outer panel 22 by means of the scoreline 26. The inner panel 16 has hingedly connected thereto on the side opposite scoreline 20 an outer panel 24 by means of the scoreline 28. The outer panels 22 and 24 have hingedly connected thereto by means of the scorelines 34 and 36 narrow flaps 30 and 32. Adhesives 38 and 40, as shown by the stippling, are applied to the narrow flaps 30 and 32 as one of the steps of production and will be described more fully hereinafter. The combination of inner panel 14, outer panel 22 and narrow flap 30 form a double thickness end wall 156 indicated by the arrow in FIG. 1 of the drawing. In a like manner inner panel 16, outer panel 24 and narrow flap 32 combine to form a double thickness end wall 158 indicated by the arrow in FIG. 1 of the drawing. Further references hereinafter to the double thickness end walls will be the numerals 156 and 158 as shown in FIG. 1.

The centrally located base portion 12 has hingedly connected on one side thereof by means of the scoreline 46 an inner panel 42 and has hingedly connected on the opposite side thereof by means of the scoreline 48 an inner panel 44. The inner panel 42 has hingedly connected thereto on the side opposite scoreline 46 a rim portion 50 by means of the scoreline 54. The inner panel 44 has hingedly connected thereto on the side opposite scoreline 48 a rim portion 52 by means of the scoreline 56. The purpose of the rim portions 50 and 52 will be described more fully hereinafter.

Hingedly connected to the rim portions 50 and 52 by means of the scorelines 62 and 64 are outer panels 58 and 60. Opposite scoreline 62 the outer panel 58 has hingedly connected thereto by means of the scoreline 70 an elongated flap 66 which has an adhesive 74, indicated by stippling, applied to its outer portion during production. The outer panel 60 has hingedly connected on the side opposite scoreline 64 an elongated flap 68 by means of the scoreline 72. The elongated flap 68 also has an adhesive 76, indicated by stippling, applied to its outer portion during production. The adhesives 74 and 76 applied to the elongated flaps 66 and 68 are applied as one of the steps of production and will be more fully described hereinafter.

The combination of inner panel 42, rim portion 50, outer panel 58 and elongated flap 66 form a spaced apart hollow side wall 152 indicated by the arrow in FIG. 1 of the drawing. In a like manner inner panel 44, rim portion 52, outer panel 60 and elongated flap 68 form a spaced apart hollow side wall 154 indicated by the arrow in FIG. 1 of the drawing. Further references hereinafter to the spaced apart hollow side walls will be the numerals 152 and 154 as shown in FIG. 1.

Securing flaps 78, 80, 82 and 84 are hingedly connected to the outer panels 58 and 60 by means of the scorelines 102, 104, 106 and 108. The purposes of the securing flaps 78, 80, 82 and 84 will be discussed in greater detail hereinafter.

Positioned between the inner panels 14, 16, 42 and 44 are a plurality of corner web-like folds shown generally by the numerals 86, 88, 90, and 92. The corner web-like folds 86, 88, 90, and 92 are hingedly attached to inner panels 14, 16, 42 and 44 by means of the scorelines 110, 112, 114, 116, 118, 120, 122 and 124. The function of the corner web-like folds 86, 88, 90 and 92 will be discussed in greater detail as the erection of the tray 10 is explained.

Figure 2:
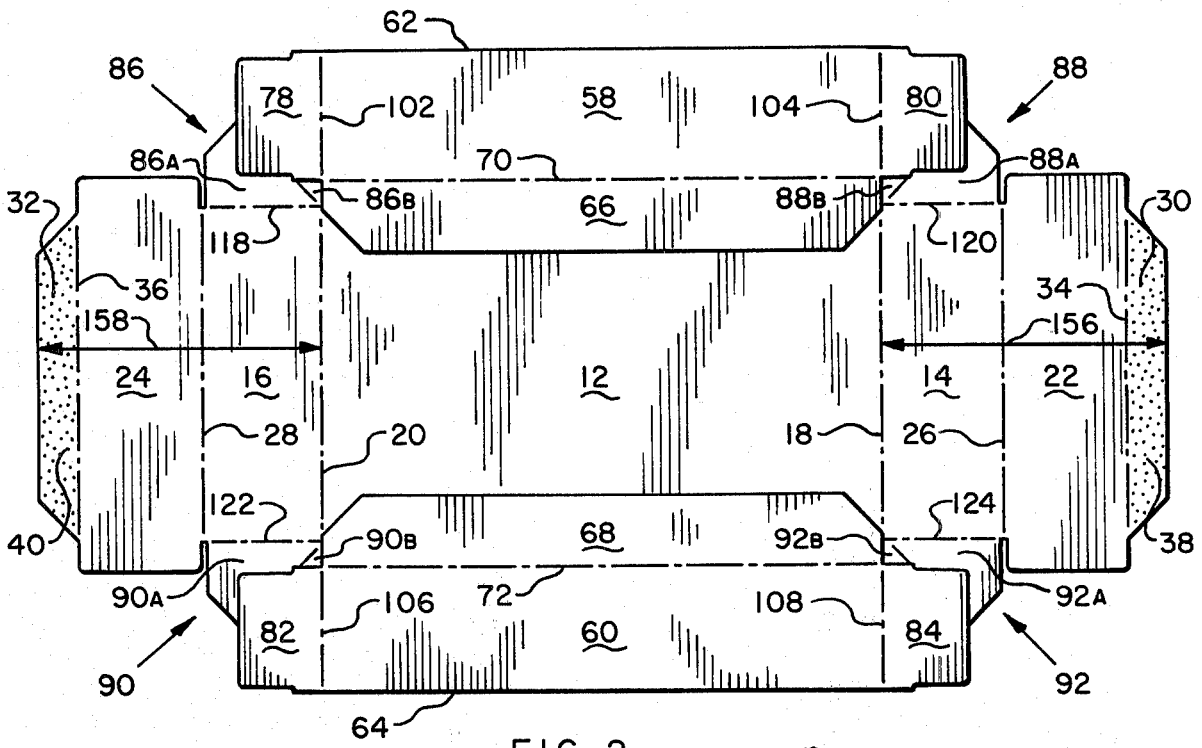
FIG. 2 is a bottom plan view of the production blank shown in FIG. 1 after the first folding sequence in which the elongated flaps are adhesively secured to the underside of the base portion of the tray.

Turning now to FIG. 2 of the drawing there is shown a bottom plan view of the production blank of FIG. 1 after the first folding sequence. The first step in erecting the frozen food tray 10 is accomplished by folding the outer panels 58 and 60 of the production blank toward the underside of the base portion 12 along scorelines 62 and 64 which hingedly connect the rim portions 50 and 52 to the inner panels 42 and 44. As a result of folding along scoreline 62, outer panel 58 is positioned above the inner panel 42 located on one side of the centrally-located base portion 12. In a like manner, folding along scoreline 64 positions the outer panel 60 above the inner panel 44 on the adjacent side of the centrally-located base portion 12. When positioned in this manner, the production blank then passes under a series of pressure rolls which apply sufficient pressure and/or heat to activate the adhesives 74 and 76 thereby adhesively bonding the elongated flaps 66 and 68 to the underside of the centrally-located base portion 12.

The width of the elongated flaps 66 and 68 is approximately one inch in the preferred embodiment. As can be seen in FIG. 1 of the drawings, adhesives 74 and 76 are applied by the maufacturer to approximately one-half the width of the underside of elongated flaps 66 and 68.

Referring now to FIG. 3 of the drawing there is shown an isometric view of the interior of the partially formed frozen food tray 10. Following the folding of the production blank shown in FIGS. 1 and 2, the packager of frozen food begins the further assembly of the frozen food tray 10. As the tray 10 moves down the packaging line, the blank is reverse folded along scorelines 46, 48, 118, 120, 122 and 124 in such a manner that inner panels 42 and 44 of the spaced apart hollow side walls 152 and 154 along with the corner web-line folds 86, 88, 90 and 92 are upstanding and perpendicular to the interior of the base portion 12 of the tray 10.

At this point a void 51 as shown in FIG. 3 is created by the rim portion 50 separating inner panel 42 and outer panel 58 of the spaced apart hollow side wall 152. On the adjacent side of the centrally-located base portion 12 a void 53 as shown in FIG. 3 is created by the rim portion 52 separating inner panel 44 and outer panel 60 of the spaced apart hollow side wall 154.

A detailed description of the corner web-like folds 86, 88, 90 and 92 in combination with the securing flaps 78, 80, 82 and 84 will reveal one of the novelty features of the applicant's frozen food tray and how the tray is completely leakproof not only from the outside of the tray but from seepage between the interior and exterior walls of the tray.

Referring back to FIGS. 1 and 3 of the drawing, corner web-like fold 86 is hingedly connected to one end of inner panel 16 by means of the scoreline 118 and is hingedly connected to one end of inner panel 42 by means of the scoreline 110 as shown in FIGS. 1 and 3 of the drawings. Formed in the central portion of corner web-like fold 86 is a scoreline 94 which forms sections **86*a* and 86*b* of corner web-like fold. In a similar manner there is shown corner web-like fold 90 being hingedly connected to one end of inner panel 16 by means of the scoreline 122 and being hingedly connected to one end of inner panel 44 by means of the scoreline 114. Formed in the central portion of corner web-like fold 90 is a scoreline 98 which forms sections 90*a* and 90*b*** of the corner web-like fold.

In a like manner of the other side of the tray there is shown the arrangement of corner web-like folds 88 and 92 in FIG. 1 of the drawing. Corner web-like fold 88 is hingedly connected to one end of inner panel 14 by means of the scoreline 120 and is hingedly connected to one end of inner panel 42 by means of the scoreline 112. Formed in the central portion of corner web-like fold 88 is a scoreline 96 which forms sections **88*a* and 88*b*.**

In a like manner, corner web-like fold 92 is hingedly connected to one end of inner panel 14 by means of the scoreline 124 and is hingedly connected to one end of inner panel 44 by means of scoreline 116. Formed in the central portion of corner web-like fold 92 is a scoreline 100 which forms sections **92*a* and 92*b*.**

Referring now to FIG. 4 of the drawing there will be discussed hereinafter the manner of folding the corner web-like folds 86, 88, 90 and 92. As can be seen in FIG. 4, corner web-like fold 86 has been folded and secured into position between inner panel 16 and securing flap 78. The folding of corner web-like fold 86 is accomplished by bringing the interior portions **86*a* and 86*b* of corner web-like fold 86 together by folding along scoreline 94 in a direction extending outwardly from the interior of the frozen food tray 10. Folding of the corner web-like fold 86 serves to bring inner panel 16 to a position which is upstanding and perpendicular to the interior of the base portion 12 of the frozen food tray 10. The corner web-like fold 86 is then turned inwardly so that the exterior portion of 86*a* of corner web-like fold 86 is positioned and secured against one end of the exterior portion of inner panel 16 and the exterior portion of 86*b* of corner web-like fold 86 is secured by securing flap 78 which is hingedly attached to one end of outer panel 58 by means of the scoreline 102. The securing flap 78 serves not only to secure the corner web-like fold 86 but also closes the void 51, shown in FIG. 3, at the bottom of the spaced apart hollow side wall 152.**

Corner web-like fold 90 is shown in FIG. 4 with the interior portion **90*a* and exterior portion 90*b* being sandwiched together just prior to being folded in the same manner as corner web-like fold 86 hereinbefore described. Thereafter, corner web-like fold 90 is secured by securing flap 82 which is hingedly attached to outer panel 60 by means of the scoreline 106 to close the void 53 shown in FIG. 3 of the drawing. While the folding of the corner web-like folds has been shown in FIG. 3** as being in a progressive sequence, it should be understood that they can be folded simultaneously within the spirit and scope of the invention.

After securing flaps 78 and 82 have been secured, the outer panel 24 is folded along scoreline 28 in a downward direction over the securing flaps 78 and 82 toward the base portion 12. Outer panel 24 then forms the exterior wall of the double thickness end wall 158. Thereafter the narrow flap 32, which is hingedly attached to the outer panel 24 by means of the scoreline 36, is folded so that the flap is beneath the base portion 12 of the frozen food tray 10. The narrow flap 32 is then adhesively secured by the adhesive 40 shown by stippling to the bottom of the base portion 12 of the frozen food tray 10.

Further reference to FIG. 4 of the drawing shows double thickness end wall 156 having been fully erected. Although not shown specifically in FIG. 4, the corner web-like folds 88 and 92 and the securing flaps 80 and 84 of this end wall are positioned against outer panel 22 in a similar manner as securing flaps 78 and 82 previously discussed. The plan view of double thickness end wall 156 can be seen by referring to FIG. 1 of the drawing.

Corner web-like fold 88, which is hingedly connected to inner panel 14 by means of scoreline 120 and is hingedly connected to inner panel 42 by means of scoreline 112, and securing flap 80 are enclosed and secured between inner panel 14 and outer panel 22 of one end of double thickness end wall 156 in the manner hereinbefore described.

In a like manner corner web-like fold 92, which is hingedly connected to inner panel 14 by scoreline 124 and is hingedly connected to inner panel 44 by means of scoreline 116, and securing flap 84 are enclosed and secured between inner panel 14 and outer panel 22 of the other end of double thickness end wall 156. The securing flap 80 also closes the void 51 at the bottom of the spaced apart hollow side wall 152 while the securing flap 84 closes the void 53 of the spaced apart hollow side wall 154.

From the foregoing it can be seen how the applicant's frozen food tray 10 is leakproof because of the manner of folding to provide a continuous interior from which no seepage of the contents should occur to the space between the spaced apart hollow side walls 152 and 154 or the double thickness end walls 156 and 158. Also the method of forming and positioning the corners of the tray wherein the corner web-like folds 86, 88, 90 and 92 in combination with the securing flaps 78, 80, 82 and 84 add still greater leakproof features. This novel feature is especially important since many packaged foods contain varying degrees of liquids such as gravies and sauces.

Referring now to FIG. 5 of the drawing there is shown the frozen food tray 10 fully erected and showing a section of the spaced apart hollow side wall 152 cut away and also a portion of the double thickness end wall 158 cut away. These sections reveal the interior structure of the frozen tray 10 and the leakproof properties of the applicant's new and novel tray, as has been just described.

Figure 6:
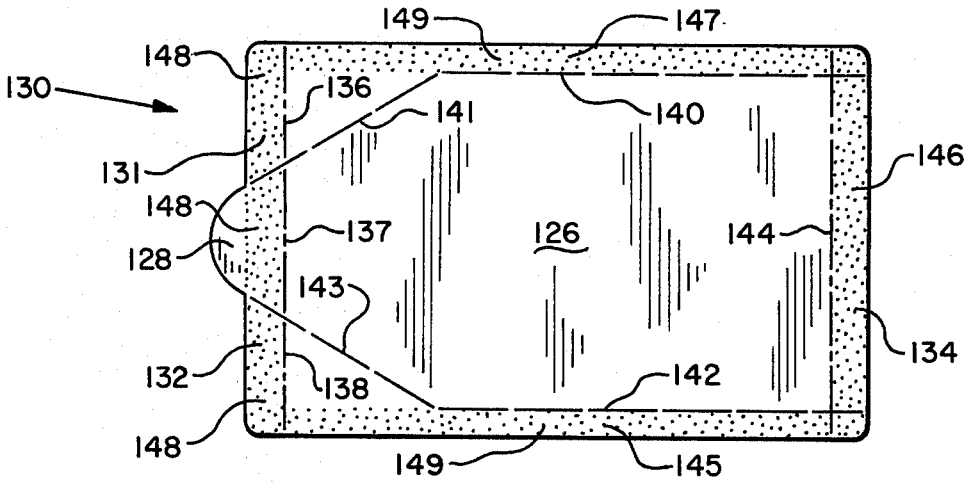
FIG. 6 is a bottom plan view of the separate one-piece lid utilized with the subject tray and having narrow flaps on the ends with an adhesive applied and a generally triangular-shaped reverse cut tear-out portion having a partially glued protuberance at the apex for removing the lid from the tray.

Turning now to FIG. 6 of the drawing there is shown a bottom plan view of the separate one-piece lid, shown generally by the numeral 130, utilized with the frozen food tray 10. The lid 130 is generally rectangular shaped having formed on the ends thereof narrow flaps 131, 132, and 134. The flaps 131 and 132 are formed by means of the cut and scorelines 136 and 138. Located in the central portion of the lid 130 is a generally triangular shaped tear-out portion 126 formed generally by means of the cut and scorelines 140, 141, 142 and 143 and having hingedly attached at one end thereof by means of the scoreline 144 a narrow flap 134 with an adhesive 146 applied as shown by the stippling. Hingedly attached on the other end thereof by means of the scoreline 137 is a protuberance 128 which is located at the apex of the triangular-shaped tear-out portion 126 and has an adhesive 148 applied to a portion thereof. Also located on the sides of protuberance 128 are narrow flaps 131 and 132 formed by the scorelines 136 and 138. A predetermined amount of adhesive 149, approximately the width of the rim portions 50 and 52 of the frozen food tray 10, is applied to elongated portions 145 and 147. Narrow flaps 131 and 132 have an adhesive 148 applied, and narrow flap 134 has an adhesive 146 applied as has been before described.

Figure 7:
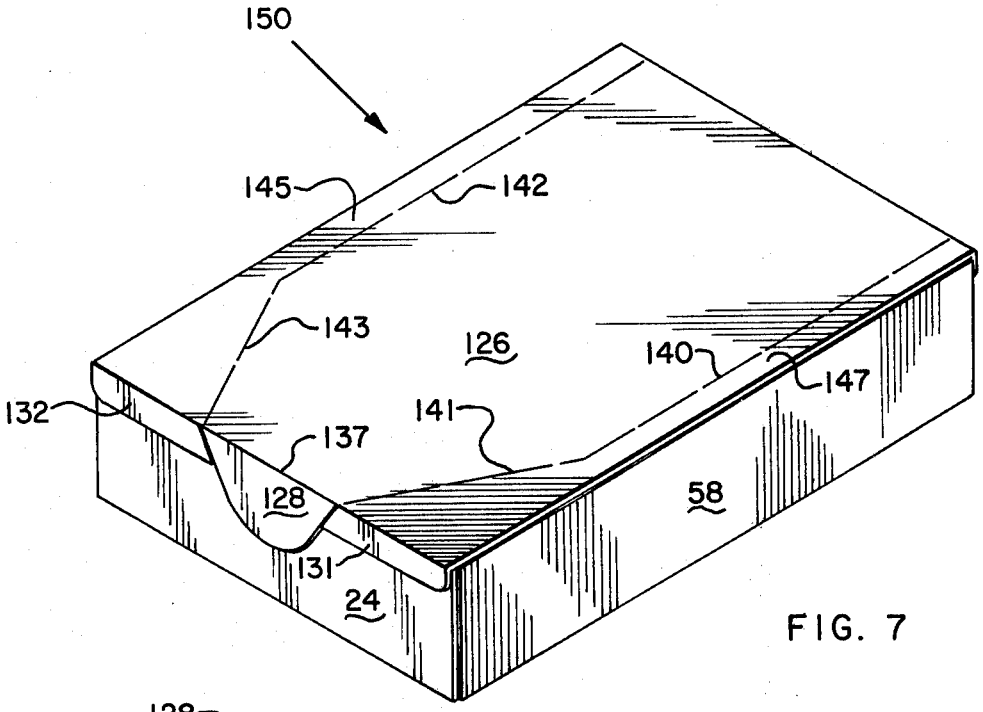
FIG. 7 is an isometric view of the frozen food tray with the lid attached to form a frozen food package.

Referring now to FIG. 7 of the drawing there is shown the frozen tray 10 with the separate one-piece lid 130 attached to form a package indicated generally by the numeral 150. After the frozen food tray 10 has been filled, the separate one-piece lid 130 is placed on top of the tray 10 so that the elongated portions 145 and 147, having adhesives 149 applied as shown in FIG. 6, rest on and are glued to the top of rim portions 52 and 50 of the frozen food tray 10. The narrow flaps 131 and 132 are folded downwardly over one end of the frozen food tray 10 along the scorelines 136 and 138 and are adhesively secured to the frozen food tray 10 while at the same time the protuberance 128 is folded downwardly along scoreline 137 and a portion thereof is adhesively secured to the frozen food tray 10. The narrow flap 134 is folded downwardly along scoreline 144 and adhesively secured at the opposite end of the frozen food tray 10. The protuberance 128 has an adhesive 148 applied to a portion thereof and is easily accessible to the user of the package to facilitate removal of the triangular-shaped tear-out portion 126 from the separate one-piece lid 130. The protuberance 128 is lifted up and torn along the cut and scorelines 140, 141, 142 and 143 of the triangular-shaped tear-out portion 126 to expose the contents of the package.

Referring again to FIG. 7 of the drawing, it is apparent that the frozen food package 150 is a complete unit and requires no additional outside packaging of the type required by the prior art structures. Not only does the package 150 have the necessary structural stability to withstand shipping and storage handling, but the packager may also imprint his advertising on the production blank and lid before assembly of the package. The shape of the package enables it to be displayed in a variety of ways such as on the side, on the ends, or in an upright position since the contents of the package are generally frozen.

Figure 8:
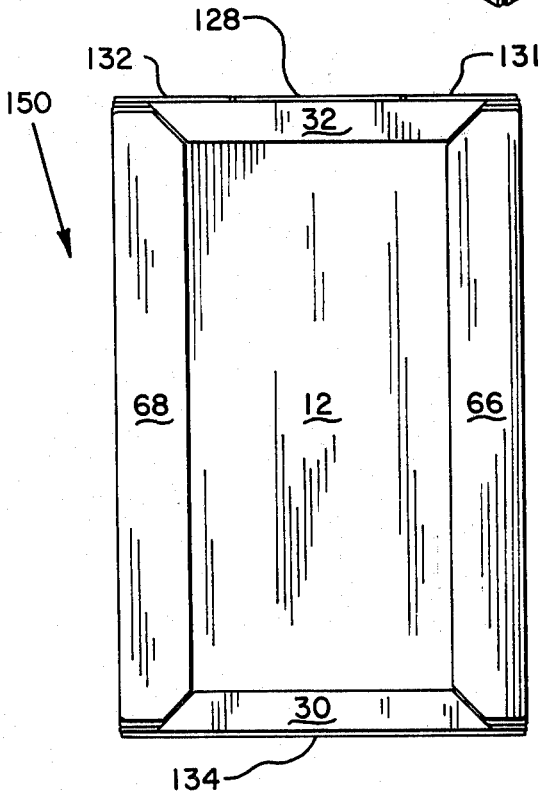
FIG. 8 is a bottom view of the frozen food package shown in FIG. 7.

Referring now to FIG. 8 of the drawing there is shown a bottom view of the frozen food package 150 having the lid 130 attached and further showing how the elongated flaps 66 and 68 and the narrow flaps 30 and 32 are positioned and secured beneath the centrally located base portion 12 of the frozen food tray 10. FIG. 8 also shows the partially glued protuberance 128 and how it is readily accessible to the user of the package to tear out the triangular-shaped tear-out portion 126.

Figure 10:
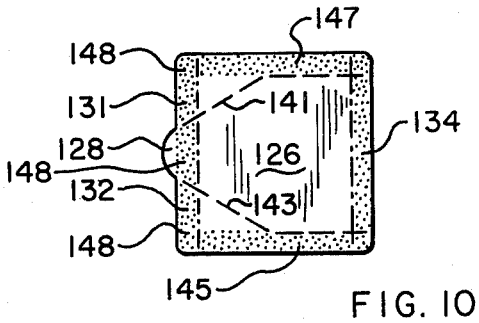
FIG. 10 is a top view of a modified frozen food package similar to that shown in FIG. 7 formed as in the shape of a square.
Figure 9:
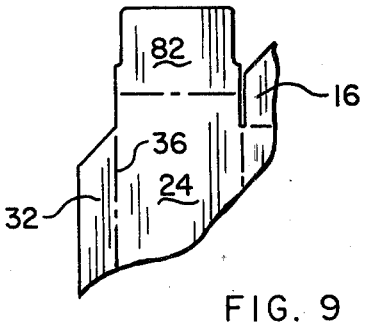
FIG. 9 is a partial plan view of the production blank shown in FIG. 1 showing a modification of the subject invention wherein the securing flaps are formed on the ends of the outer panel of the end walls.

Referring now to FIGS. 9 and 10 of the drawings, modifications of the package shown in FIG. 7 are shown. The securing flaps 78, 80, 82 and 84 could conceivably be formed on the ends of outer panels 22 and 24 and adhesively secured to the outer panels 58 and 60 of the spaced apart hollow side walls 152 and 154. FIG. 9 of the drawing shows a partial plan view of the production blank shown in FIG. 1 wherein securing flap 82 is formed on one end of outer panel 24 and would be folded and secured adhesively against outer panel 60 of the spaced apart hollow side wall 154. In this embodiment securing flap 78 would be formed on the opposite end of panel 24 and adhesively secured to outer panel 58 of the spaced apart hollow side wall 152. In a like manner securing flaps 80 and 84 would be formed on the ends of outer panel 22. Securing flap 80 would be adhesively secured on one end of outer panel 58 of spaced apart hollow side wall 152, and securing flap 84 would be adhesively secured on the opposite end of outer panel 22 to outer panel 60 of the spaced apart hollow side wall 154.

Turning now to FIG. 10 of the drawing there is shown a modification of the frozen food package 150 shown in FIG. 7 formed in the shape of a square. It should become apparent that other shapes of the package could be designed within the spirit and scope of the invention. When the frozen food tray 10 is manufactured in one of the various shapes hereinbefore described, it should be noted that the adhesives 74 and 76 may be water base or heat activated or some other type of adhesive and are applied to the elongated flaps 66 and 68 as shown by the stippled area in FIG. 1 of the drawing as the production blank is being formed. Also the adhesives 38 and 40 may be water base or heat activated or some other type of adhesive and are applied as one of the steps of production. FIG. 2 of the drawing shows the partially assembled tray as it appears when shipped to the packager of frozen food wherein the elongated flaps 66 and 68 are glued in place.

Figure 11:
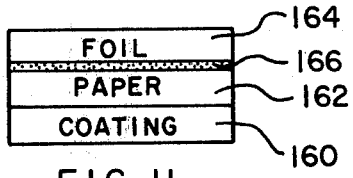
FIG. 11 is a sectional view taken along lines 11—11 of FIG. 4 showing a modification wherein the tray is formed with a foil/paper/coating combination.

The subject frozen food tray and lid may be formed of various combinations of materials such as foil, coatings, and other elements within the spirit and scope of the invention. In the preferred embodiment the tray and lid are formed basically of paperboard and may be coated on one side with a foil application applied on the other side of the paperboard. Such a configuration is shown generally in FIG. 11 of the drawing wherein a desired coating 160 is applied to one side of the paperboard 162 with the other side of the paperboard 162 having a foil 164 attached thereto by means of an adhesive 166.

Figure 12:
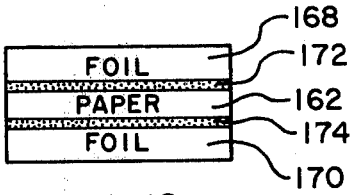
FIG. 12 is a sectional view also taken through lines 11—11 of FIG. 4 showing a modification wherein the tray is formed with a foil/paper/foil combination.

It may also be desirous to provide the subject frozen food package with a combination of foils on both sides of the paperboard, and such a combination is typified in FIG. 12 of the drawing wherein the paperboard 162 has applied on one side thereof a foil 168 and on the other side thereof a foil 170. The foil 168 is bonded to the paperboard 162 by means of the adhesive 172 while the foil 170 is bonded to the paperboard 162 by means of the adhesive 174.

It should also be noted that the applicant's tray and lid as shown by the various figures from 1–10, could also be manufactured with coatings on one or both sides of the paper without any foil if desired by the particular customer and could also be manufactured without any coatings at all within the spirit and scope of the invention. It should also be noted that while paperboard has been described as the preferred embodiment of the subject package structure, other materials may also be substituted for paperboard within the spirit and scope of the invention.

In summary, there has been provided by the subject application a new and novel tray which may be utilized for storing and reheating of frozen food with the tray having novel spaced apart hollow side walls and double thickness end walls which are adhesively secured to the underside of the tray. This construction, in combination with novel corner web-like folds, makes the interior portion of the tray leakproof in such a manner that the contents of the tray are retained within the package and cannot leak to the inside of the tray between the side and end walls of the exterior portion of the tray.

From the foregoing it can be seen that the new and novel frozen food package also has new and novel structural advantages and stability which enable the package to withstand shipping and storage handling without the need for an additional outer package. The subject package may also have imprinted on its exterior portion any desired advertising of the packager to thusly eliminate the need for an expensive outer package and resulting in a speeding up of the packaging line. While the package described herein has been shown in the preferred embodiment for illustration purposes only, it is understood that various changes and modifications may be made to the tray, lid and package as a unit without departing from the spirit and scope of the invention.

Having described my invention, I claim:

1. A tray for storing and reheating food comprising
a centrally located base portion having a pair of sides and a pair of ends;
opposing inner and outer side-wall panels;
said side-wall panels connected therebetween by a rim portion to form spaced apart hollow side walls formed on each side of said base portion
said inner side-wall panels being hingedly connected and perpendicular to said base portion;
said inner side-wall panels having hingedly connected thereto said rim portion which lies parallel to said base portion;
said rim portion having hingedly connected thereto said outer side-wall panels on the side opposite said inner side-wall panels;
said outer side-wall panels having hingedly connected on the outer edge thereof an elongate flap;
said elongate flap being adhesively secured to the underside of said base portion;
opposing inner and outer end-wall panels formed on each end of said base portion;
said inner end-wall panels being hingedly connected and perpendicular to said base portion;
said outer end-wall panels being hingedly connected to said inner end-wall panels;
said outer end-wall panels having hingedly connected on the outer edge thereof a narrow flap;
said narrow flap being adhesively secured to the underside of said base portion;
corner web-like folds hingedly connected and positioned between said inner side-wall panels and said inner end-wall panels;
said corner folds having a scoreline in the central portion thereof for folding the interior surfaces of the corner folds against each other;
securing flaps formed on said outer side-wall panels;
said securing flaps being folded over and disaposed adjacent said corner folds;
interior and exterior portions of said tray being formed from foil laminated paperboard;
a separate one-piece lid being adhesively secured to the package;
said lid having a generally triangular-shaped, reverse cut tear-out portion, and
said tear-out portion having a partially glued protuberance at one end thereof.

* * * * *

UNITED STATES PATENT OFFICE

CERTIFICATE OF CORRECTION

PATENT NO. : 4,003,514

DATED : January 18, 1977

INVENTOR(S) : Earl J. Graser

It is certified that error appears in the above-identified patent and that said Letters Patent are hereby corrected as shown below:

Column 2, Line 12, between the words "new" and "novel" insert the word -- and --.

Column 2, Line 66, between the words "new" and "novel" insert the word -- and --.

Column 2, Line 68, omit the word "extend" and insert in place thereof the word -- extent --.

Column 3, Line 65, following the word "combination;" insert the word -- and --.

Column 4, Line 41, omit the word "purpose" and insert in place thereof the word -- purposes --.

Column 5, Line 46, omit the word "web-line" and insert in place thereof the word -- web-like --.

Column 6, Line 2, between the words "of" and "corner" insert the word -- the --.

Column 6, Line 10, following the word "manner" omit the word "of" and insert in place thereof the word -- on --.

Column 7, Line 3, omit the word "strippling" and insert in place thereof the word -- stippling --.

Column 7, Line 49, between the words "frozen" and "tray" insert the word -- food --.

Column 7, Line 65, omit the word "strippling" and insert in place thereof the word -- stippling --.

UNITED STATES PATENT OFFICE
CERTIFICATE OF CORRECTION

PATENT NO. : 4,003,514
DATED : January 18, 1977
INVENTOR(S) : Earl J. Graser

It is certified that error appears in the above-identified patent and that said Letters Patent are hereby corrected as shown below:

(Continued from Page 1)

Column 8, Line 11, between the words "frozen" and "tray", insert the word -- food --.

Column 10, Line 4, following the word "walls" omit the word "of" and insert in place thereof the word -- or --.

Column 10, Line 57, omit the word "disaposed" and insert in place thereof the word -- dispensed --.

Signed and Sealed this
Seventh Day of June 1977

[SEAL]

*Attest:*

RUTH C. MASON
*Attesting Officer*

C. MARSHALL DANN
*Commissioner of Patents and Trademarks*